US009358597B2

(12) United States Patent
Beeston et al.

(10) Patent No.: US 9,358,597 B2
(45) Date of Patent: Jun. 7, 2016

(54) APPARATUS AND METHOD FOR CONTROLLED COOLING

(75) Inventors: John Edward Beeston, Dorset (GB); Michael Trevor Clark, Sheffield (GB)

(73) Assignee: SIEMENS PLC (GB)

( * ) Notice: Subject to any disclaimer, the term of this patent is extended or adjusted under 35 U.S.C. 154(b) by 468 days.

(21) Appl. No.: 12/521,145

(22) PCT Filed: Nov. 19, 2007

(86) PCT No.: PCT/EP2007/009983

§ 371 (c)(1),
(2), (4) Date: Jul. 16, 2009

(87) PCT Pub. No.: WO2008/077449

PCT Pub. Date: Jul. 3, 2008

(65) Prior Publication Data

US 2010/0044024 A1 Feb. 25, 2010

(30) Foreign Application Priority Data

Dec. 27, 2006 (EP) ..... EP06256592

(51) Int. Cl.
*B05B 1/14* (2006.01)
*B21B 45/02* (2006.01)

(52) U.S. Cl.
CPC ..... *B21B 45/0233* (2013.01); *B21B 45/0218* (2013.01)

(58) Field of Classification Search
CPC ..... B21B 45/0233; B21B 45/0218
USPC ..... 239/550, 574, 581.2, 566; 137/587, 137/588, 596, 198–218
See application file for complete search history.

(56) References Cited

U.S. PATENT DOCUMENTS 2,627,868 A * 2/1953 Runnels ..... 137/198
3,315,611 A * 4/1967 Thompson ..... C10M 175/00 137/209
3,490,482 A * 1/1970 Sachs ..... G03D 3/06 137/205
3,841,559 A 10/1974 Hall et al.
4,480,661 A * 11/1984 Kawai et al. ..... 137/544
4,723,562 A * 2/1988 Wilmotte ..... B21B 45/0218 134/122 R
4,744,226 A 5/1988 Noville et al.

(Continued)

FOREIGN PATENT DOCUMENTS

CA 1 262 671 11/1989
EP 0 176 494 A1 4/1986

(Continued)

OTHER PUBLICATIONS

International Search Report dated Mar. 7, 2008, issued in corresponding international application No. PCT/EP2007/009983.

(Continued)

*Primary Examiner* — Len Tran
*Assistant Examiner* — Joel Zhou
(74) *Attorney, Agent, or Firm* — Ostrolenk Faber LLP

(57) ABSTRACT

An apparatus for controlled cooling and a control method related to controlled cooling of hot plate or strip shaped metal. The apparatus comprises a header fitted with a first valve which allows air to escape from the header and prevents cooling fluid escaping from the header when being filled and prevents air from getting back into the header. During operation due to the apparatus an improved operation even at low flow rates is possible.

8 Claims, 1 Drawing Sheet

(56) References Cited

U.S. PATENT DOCUMENTS

| | | | | |
|---|---|---|---|---|
| 6,247,487 | B1 * | 6/2001 | Skill | F15B 21/044 137/198 |
| 6,513,541 | B1 * | 2/2003 | Herlihy | 137/202 |
| 6,526,921 | B1 * | 3/2003 | Roffelsen | 122/406.1 |
| 6,698,667 | B2 | 3/2004 | Klempel | 239/128 |
| 2006/0060271 | A1 | 3/2006 | Fujibayashi et al. | |
| 2006/0102746 | A1 * | 5/2006 | Buswell | B05B 9/04 239/373 |
| 2007/0034256 | A1 * | 2/2007 | Ramoth | 137/202 |

FOREIGN PATENT DOCUMENTS

| | | | | |
|---|---|---|---|---|
| EP | 0 178 281 | A2 | 4/1986 | |
| EP | 0178281 | | 4/1986 | |
| EP | 0178281 | A2 | 4/1986 | |
| EP | 0 233 854 | B1 | 4/1990 | |
| EP | 0 297 077 | B1 | 6/1993 | |
| JP | 59 050911 | A | 3/1984 | |
| JP | 59-094708 | | 5/1984 | |
| JP | 61-179814 | | 8/1986 | |
| JP | 63-057727 | | 3/1988 | |
| JP | 2627868 | | 7/1997 | |
| JP | 9-294943 | | 11/1997 | |
| JP | 10-235425 | | 9/1998 | |
| JP | 10235425 | | 9/1998 | |
| JP | 10-296320 | * | 10/1998 | B21B 45/02 |
| JP | 10-296320 | | 11/1998 | |
| JP | 10296320 | | 11/1998 | |
| JP | 2002011513 | | 1/2002 | |
| JP | 2004-313933 | | 11/2004 | |
| JP | 2005-315116 | | 11/2005 | |
| RU | 2264875 | | 11/2005 | |

OTHER PUBLICATIONS

Notice of Reasons for Rejection and English language translation issued in corresponding Japanese Patent Application No. 2009-543350 issued on Dec. 18, 2012.

Russian Federation Decision on Grant, dated Jun. 6, 2012, issued in corresponding Russian Patent Application No. 2009128691/02(039897), filed Nov. 19, 2007. English translation included. Total 12 pages.

Japanese Office Action dated Jun. 1, 2015 issued in Japanese Application No. 2014-011171 with an English language translation.

CN Office Action dated Nov. 4, 2014. (3 pages).

* cited by examiner

APPARATUS AND METHOD FOR CONTROLLED COOLING

CROSS REFERENCE TO RELATED APPLICATION

The present application is a 35 U.S.C. §§371 national phase conversion of PCT/EP2007/009983, filed Nov. 19, 2007, which claims priority of European Application No. EP06256592, filed Dec. 27, 2006, the disclosure of which is incorporated by reference herein. The PCT International Application was published in the English language.

BACKGROUND OF THE INVENTION

The invention relates to the general field of controlled cooling of hot plate or strip shaped metal and specifically to the accelerated cooling and direct quenching of steel strips and plates.

The controlled cooling of hot rolled steel is very important for achieving the desired microstructure and properties. Modern plate and hot strip mills generally use powerful cooling systems for this purpose whereby the accurate control of the temperature and the cooling rate are very important. Water is often used as a cooling fluid.

There are many different designs of cooling system available from the prior art. One of the most common types is the U-tube type laminar cooling header. The main water supply is via a large diameter pipe and the water flows out of a plurality of U-tubes and down onto the product which is being cooled. The reason that U-tubes are used is so that the main supply pipe stays full of water even when the flow is switched off. This means that the time delay between switching on the flow and water coming out of the U-tubes is minimized. It also means that when the flow is switched off only a small quantity of water drips out of the U-tubes.

However there are a number of limitations with U-tube type headers. In practice it is found that U-tubes only give a sharply defined flow pattern over a limited range of flows. The ratio between the minimum and maximum flows which give a good flow pattern is typically about 3:1. Another limitation is that the jets are a large distance above the product which is being cooled which reduces the cooling efficiency.

Due to the limitations of conventional U-tube designs, many modern systems use multi-jet type headers instead. Some of these designs are described in EP 0 176 494, EP 0 178 281, EP 0 233 854 and EP 0 297 077. A main water supply pipe feeds water into a header. Inside the header are a large number of nozzles which produce a large number of water jets. There are a number of advantages to this type of multi-jet header design. The large numbers of jets provide much greater cooling power than U-tube type headers. In addition the design allows the jets to be much closer to the product being cooled and this further increases the cooling power. The large numbers of small jets also allow a much wider range of stable flows to be used. The ratio between the minimum and maximum stable flows is 20:1 or more compared to around 3:1 for U-tubes.

Whilst the multi-jet type header offers many advantages over the U-tube type headers it does have some disadvantages. When the flow is switched off the water in the supply pipe drains out through the nozzles. This is undesirable because the water could drip onto products that do not require any further cooling. It also means that when the flow is switched on for the next product that does require cooling the supply pipe has to be re-filled before the flow is properly established.

Another undesirable feature is that at low flows it takes a long time to change the flow. The reason for this is that the flow out of the nozzles is proportional to the square-root of the pressure at the nozzles. At maximum flow the pressure in the header is typically about 4 bar or roughly 40 meters head of water. With a 20:1 ratio between minimum and maximum flow, the pressure required for minimum flow is therefore only 40/(20×20) meters which is only 0.1 meters. Since the supply pipe is typically 300 mm in diameter this means that for minimum flow the supply pipe is only partially full. If the flow into the supply pipe is changed the flow out of the nozzles will not match the flow into the supply pipe until the water level in the pipe has reached the correct new equilibrium level. This can take up to 100 seconds or more at very low flows.

SUMMARY OF THE INVENTION

It is therefore an objective of the present invention to overcome the disadvantages of the multi-jet type cooling header by making it possible to change the flow quickly even at low flow rates. Another objective of the invention is to enable the correct flow to be established more quickly and to stop the dripping of the water when the flow is switched off.

The objective is solved by the apparatus and method of the invention.

According to the present inventive apparatus a first valve is arranged so as to allow air to escape from the header when the header is being filled with the cooling fluid and to prevent air from getting back into the header. The first valve is installed so that it connects to the highest part of the header with a connecting pipe. The first valve allows air to escape from the header and prevents cooling fluid from escaping from the header when being filled with the cooling fluid. The apparatus according to the invention allows a quick switching on and off. It can be assured that the header is fully filled and when working at lower flow rates stable operation can be assured.

According to a special embodiment of the inventive apparatus the first valve is a float type valve. This valve allows air out of the header but prevents the cooling fluid from escaping when the header is full.

According to a special embodiment of the inventive apparatus a second valve is connected to the first valve. The second valve prevents air from going back into the header.

According to a further special embodiment of the inventive apparatus the second valve is a non-return valve. This avoids the ingress of air into the header when the pressure in the header drops.

According to a suitable embodiment of the inventive apparatus the first valve is an electrically operated valve which is operated so as to allow air out of the header when the header is being filled and to prevent air from getting back into the header when the header is full. Due to this operation mode a fully automated control is possible.

Another suitable embodiment is achieved when the second valve is an electrically operated valve. This allows an improved control of the header.

In an advantageous embodiment of the inventive apparatus an electrically operated solenoid valve is arranged in the connecting pipe between the first and the second valve, which allows air back into the header for draining of the header. This additional valve assures quick drain of the header when required.

Furthermore the advantageous embodiment of the inventive apparatus can be extended by a drain valve, which is attached to the header, in particular to the nozzle carrier and which allows even quicker drain of the cooling fluid from the header. This is of relevance whenever uncontrolled dripping from the header or the nozzles has to be avoided.

According to the inventive control method for the operation of an apparatus for the controlled cooling of hot plate or strip shaped metals, in particular steel, by means of a cooling fluid, with a header, comprising a central supply pipe and a plurality of nozzles arranged in a nozzle carrier, the header is completely filled with water and air is prevented from entering into the header during operation by means of a first valve. Due to the controlled filling and control of the air getting back into the header or being allowed to escape the flow conditions can be controlled to a much greater extent.

A preferred embodiment of the inventive control method is characterized in that the first valve is operated so as to allow air out of the header when the header is being filled and to prevent air from getting back into the header when the header is full.

Another preferred embodiment of the inventive control method is characterized in that a measured pressure in the header is used as an input value for the control of the first valve. The pressure allows an improved detection of the current filling level in the header. Other measurements e.g. the filling level in the header could be use as well.

According to a special embodiment of the inventive control method during filling of the header the flow rate of the fluid supplied from a fluid supply is increased. This assures a completely filled header and a quick filling allowing a quick response when the header has to be put in operating conditions. Further more the increased flow rate assures that air is completely removed from the header.

According to a special embodiment of the inventive control method the header remains fully filled during operation. This special condition allows a stable operation of the header even when the flow rate of the cooling fluid at the nozzles is reduced to low values. Further more changes to the flow rate into the header cause the flow rate out of the nozzles to change immediately because the header remains full all the time and the height of water in the header and supply pipe does not have to change in order to change the pressure at the nozzles.

According to a preferred embodiment of the inventive control method a partial vacuum is created in the header such that the fluid pressure at the nozzles is smaller than the pressure due to the height of water in the header. The method assures that no air can ingress the header even at low flow rates of the cooling fluid. As a consequence the flow rate can be reduced to a much lower value than with conventional headers as no air can get into the header. Thus even at low flow rates the system and the flow of cooling fluid remains stable.

The invention is described in more detail in the following figures presenting possible embodiments of the present invention without limiting the invention to the presented embodiments.

DESCRIPTION OF PRIOR ART AND OF A PREFERRED EMBODIMENT

Figure 1:
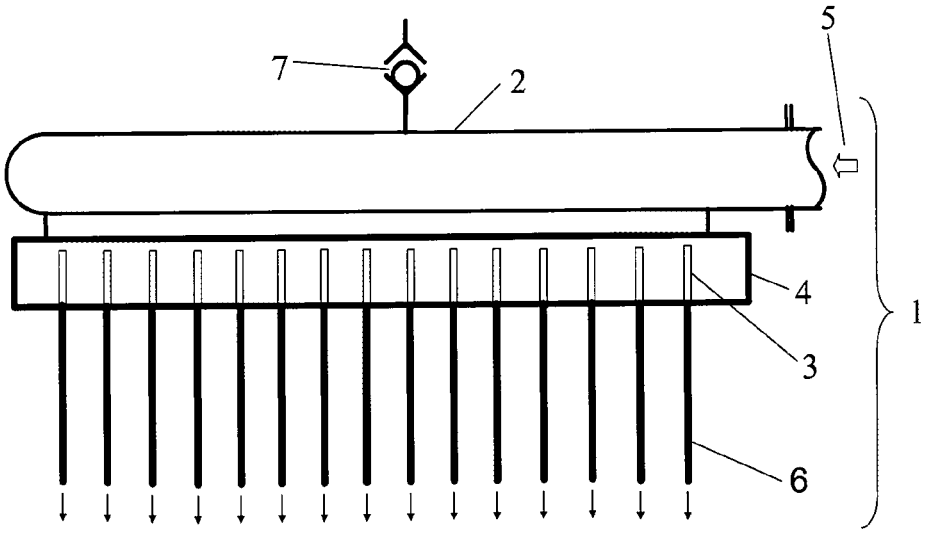
FIG. 1: Sectional view of a header according to prior art

FIG. 1 shows a header 1 with a supply pipe 2 and a plurality of nozzles 3 arranged in a nozzle carrier 4. The cooling medium enters the header at 5. From the main supply pipe 2 the cooling medium then flows into the nozzle carrier 4 and out through the nozzles 3. Cooling medium jets 6 are created by the nozzles 3. Water is often used as the cooling medium however according to the invention other media or mixtures of media might be used. A float type valve 7 is connected to the highest point of the header 1 which in this embodiment is the top of the supply pipe 2. The float type valve 7 allows air to escape from the header 1 when the cooling fluid is switched on but it does not allow cooling fluid to escape. Once the header 1 and supply pipe 2 are full of cooling fluid the float rises and seals off the outlet.

In a header according to the prior art if the flow into the header at 5 is reduced so that the head of cooling fluid required to produce this flow out of nozzles 3 is less than the height of the top of the supply pipe 2 above the nozzles then the float type valve 7 will allow air back into the header 1 and the cooling fluid level in the supply pipe 2 will drop until the flow out of the nozzles matches the flow into the header. Due to the large volume of the header it can take up to 100 seconds or even longer before the height of water in the header stabilises and the flow out 6 of the nozzles 3 is equal to the flow into the header 5. The header according to the invention overcomes such problems.

Figure 2:
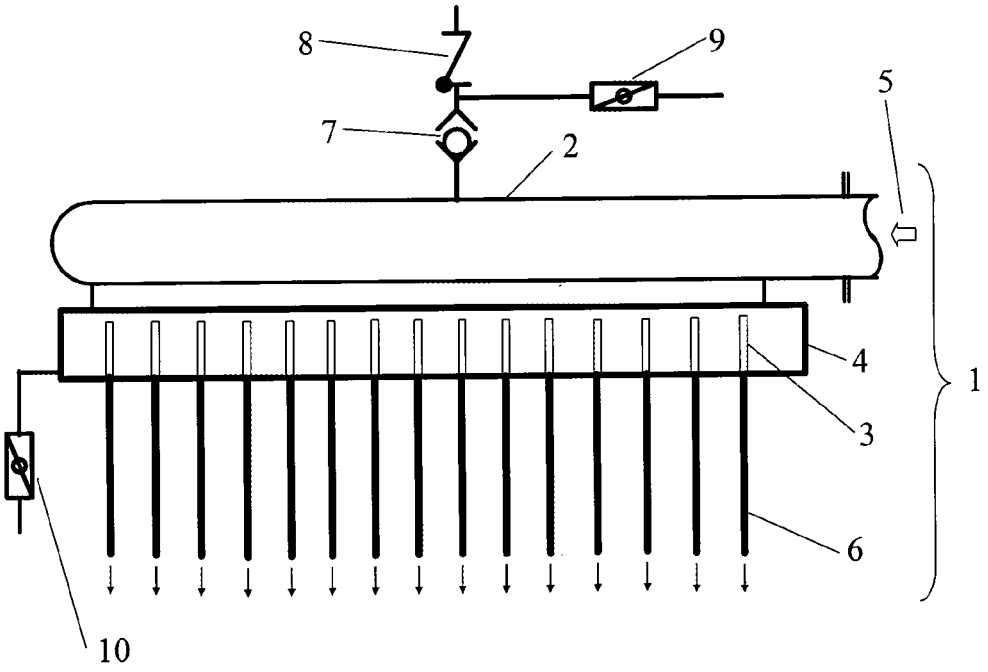
FIG. 2: Sectional view of a header according to the invention.

FIG. 2 shows the header according to the invention with the addition of a non-return valve 8 which is connected to the float valve 7. This non-return valve prevents air from getting back into the system.

The combination of the float type valve 7 and the non-return valve 8 improves the operation of the system considerably. Because the header is full of water even at low flows then changes to the flow into the header 5 cause an immediate change in the flow out of the nozzles 3.

In addition the draining of the header 1 when the flow is switched off is much reduced. This means that there is less cooling fluid dripping out of the header 1 when it is not in operation and that when flow is required it switches on almost instantaneously because the header 1 is already full.

To further improve the operation of the system a particular control method is required in combination with the float type valve 7 and the non-return valve 8. When the cooling fluid flow 5 is first switched on a large flow is used to ensure that the header 1 is completely full. To make sure that the system is completely full of cooling fluid this flow must be large enough that the head of cooling fluid required to produce this flow through the nozzles 3 is greater than the height of the non-return valve 7 above the nozzles 3. The larger the flow that is used during this pre-filling step the quicker the header 1 will fill up.

Once the header 1 is full the cooling fluid flow 5 can be reduced to the required level. The non-return valve 8 prevents air from getting back into the header 1 so the cooling fluid level cannot drop and the system stays full of cooling fluid. If the required flow is low then a partial vacuum is created in the upper part of the supply pipe 2 so that the pressure of cooling fluid at the nozzles 3 reaches the correct equilibrium pressure where the flow out of the nozzles 3 matches the flow into the header 1. The flow out of the nozzles 3 responds almost instantaneously to changes in the flow going into the header 1 because the system stays full of cooling fluid and all that changes is the pressure in the header 1.

If the apparatus for the controlled cooling is not going to be in operation for some time or it is necessary to stop any cooling fluid from dripping out of the header 1 it may be desirable to allow the cooling fluid to drain out of the header 1. In this case an electrically operated solenoid valve 9 can be opened to allow air back into the header 1 to let the cooling fluid drain out through the nozzles 3. An additional valve 10 can be added to provide faster draining if required.

It will be apparent that the exemplary embodiment using a float type valve 7 and non-return valve 8 is a simple method of achieving the desired objectives but that these same objectives could be achieved by other embodiments such as electrically operated valves. The principal of the invention is that the header 1 is completely filled with cooling fluid and air is prevented from entering even when the pressure required to produce the desired flow is less than the height of the system above the nozzles 3 and a partial vacuum is created to achieve this.

The invention claimed is:

1. An apparatus for controlled cooling of hot plate or strip shaped metals using a cooling liquid, the apparatus comprising:

a header comprising a central supply pipe;

a nozzle carrier and a plurality of nozzles arranged in the nozzle carrier;

a first valve connected by a conduit to the header, the first valve comprising a float valve configured to allow air to escape from the header when the header is being filled with the cooling liquid and to prevent the cooling liquid from escaping when the header is full;

the first valve comprising a non-return valve configured to prevent air from getting back into the header, when pressure required to produce a target flow of the cooling liquid is less than a pressure provided by a height of the system above the nozzles, wherein the float valve is connected between the header and the non-return valve; and a solenoid valve positioned in a connecting pipe leading to a connecting point between the float valve and the non-return valve, the solenoid valve in an open state permitting air to pass through the connecting pipe through the connecting point to the float valve so as to allow the air back into the header so as to drain the cooling liquid from the header, and in a closed state to prevent the air from passing to the float valve.

2. The apparatus as defined in claim 1, wherein the first valve is electrically operable.

3. The apparatus as defined in claim 1, further comprising a drain valve attached to the header at the nozzle carrier and operable to allow quick drain of the cooling liquid from the header.

4. A control method for operation of an apparatus for controlled cooling of hot plate or strip shaped metals by means of a cooling liquid, the apparatus comprising a header comprising a central supply pipe, a nozzle carrier and a plurality of nozzles arranged in the nozzle carrier, the method comprising:

completely filling the header with cooling liquid using a first valve comprising a float valve and a non-return valve, and preventing, using the float valve, the cooling fluid from escaping when the header is full;

during the filling, preventing, using the non-return valve, air from entering into the header; and creating a partial vacuum in the header when the cooling liquid pressure above the nozzles is smaller than a pressure required for a target flow rate of the cooling liquid from the nozzles by the non-return valve preventing the air entering the header, wherein the float valve is connected between the header and the non-return valve; and a solenoid valve positioned in a connecting pipe leading to a connecting point between the float valve and the non-return valve, the solenoid valve in an open state permitting air to pass through the connecting pipe through the connecting point to the float valve so as to allow the air back into the header so as to drain the cooling liquid from the header, and in a closed state to prevent the air from passing to the float valve.

5. The control method as defined in claim 4, further comprising operating the first valve to allow air out of the header when the header is being filled and to prevent air from getting back into the header when the header is full.

6. The control method as defined in claim 5, further comprising using a measured pressure in the header as an input value for control of the first valve.

7. The control method as defined in claim 5, further comprising during filling of the header, increasing the flow rate of the cooling liquid supplied from a fluid supply.

8. The control method as defined in claim 5, wherein the header remains fully filled during operation.

* * * * *